US005533354A

United States Patent [19]

Pirkle

[11] Patent Number: 5,533,354

[45] Date of Patent: Jul. 9, 1996

[54] PERSONAL COMFORT APPARATUS

[75] Inventor: Fred L. Pirkle, Abington, Pa.

[73] Assignee: Texan Corporation, Horsham, Pa.

[21] Appl. No.: 309,042

[22] Filed: Sep. 20, 1994

[51] Int. Cl.[6] ..... F25D 23/12

[52] U.S. Cl. ..... 62/259.3; 2/2

[58] Field of Search ..... 62/259.3; 165/46; 2/2

[56] References Cited

U.S. PATENT DOCUMENTS

| | | | |
|---|---|---|---|
| 2,171,337 | 8/1939 | Hellman et al. . | |
| 2,359,926 | 10/1944 | McCullough et al. | 29/157.3 |
| 2,460,269 | 2/1949 | Appeldoorn | 62/259.3 X |
| 2,540,547 | 2/1951 | Rodert . | |
| 2,713,510 | 7/1955 | Coanda . | |
| 2,910,230 | 11/1959 | Rataiczak | 62/516 X |
| 3,047,208 | 7/1962 | Coanda . | |
| 3,430,688 | 3/1969 | Crocker . | |
| 3,610,323 | 10/1971 | Troyer | 62/259.3 X |
| 4,572,188 | 2/1986 | Augustine et al. | 165/46 X |
| 4,738,119 | 4/1988 | Zafred . | |
| 4,998,415 | 3/1991 | Larsen . | |
| 5,255,390 | 10/1993 | Gross et al. . | |
| 5,263,336 | 11/1993 | Kuramarohit . | |
| 5,303,425 | 4/1994 | Mele . | |
| 5,353,605 | 10/1994 | Naaman | 62/259.3 |

OTHER PUBLICATIONS

Alexandr et al, Use of Vortex Tube for Cooling Wearers of Industrial Protective Clothing, E. I. Du Pont De Nemours & Company, Oct. 1963.

*Primary Examiner*—William E. Tapolcai
*Attorney, Agent, or Firm*—Howson and Howson

[57] ABSTRACT

A personal cooling apparatus comprises a harness constructed of perforated tubing to provides air circulation over the body of a wearer. The tubing has at least one fin adjacent the perforations to enhance the induction of flow of ambient air by gas escaping through the perforations. The tubing is extruded and has an footing strip formed on it to maintain it in a specific position and to permit the tubing to be attached to the interior of a garment. The effect is to create, at each perforation, a small fan, and the harness thereby circulates air against the skin of the wearer. The tubing can be sewn onto the inner or outer surface of a lightweight garment.

11 Claims, 8 Drawing Sheets

PERSONAL COMFORT APPARATUS

BACKGROUND OF THE INVENTION

Protecting workers from heat-related injury or stress is very important in most modern companies. For example, for employees working near blast furnaces and steam generators, in foundries, or in enclosed areas, it is very important that personal cooling devices be available to reduce the risk of heat stress. In general, these personal cooling devices take the form of garments that are worn by the workers. The garments provide ventilation by supplying a flow of air near the worker's body. One of the major expected benefits of such garments is that they provide a steady flow of moving air or some other cool gas near or next to the surface of the skin of the wearer. Another major expected benefit is that these devices are portable and have lightweight construction. Finally, as the temperature changes, the flow rate of gas can be monitored, and adjusted to keep the worker comfortable.

U.S. Pat. No. 4,738,119, by P. Zafred and assigned to Westinghouse Electric Corp., discloses a device for enhancing personal comfort in the form of a garment having outer and inner linings stitched together, with a plurality of tubes disposed between the inner and outer linings. A charge of liquefied carbon dioxide must first be delivered under high pressure into the tubes. The carbon dioxide is converted to a solid phase in the tubes and eventually sublimes to gaseous carbon dioxide, which escapes through micropores in the tubes.

Another such device is described in U.S. Pat. No. 5,303,425 to P. Mele. This patent describes a generally helical tubular structure attached to the inner portion of a garment. The tubular structure has discrete expansion points disposed at spaced intervals. These expansion points are inflated, for example by blowing into one end of the tube, and the garment is lifted away from the wearer's skin to allow increased air circulation next to the skin.

Still another type of cooling device is described in U.S. Pat. No. 5,255,390 to S. Gross et al. The patent shows a gas-ventilated garment with a plurality of radial dispersion valves positioned at various locations and connected to receive air at a pressure of 20 to 125 pounds per square inch. Each valve releases ventilating air against the skin at low pressure and in a radial direction, thereby achieving cooling.

Although the above-noted cooling devices and similar devices are capable of producing a cooling effect, they are of limited efficiency and are generally complex. None of these devices takes full advantage of the principle known as the "Coanda effect". This principle of fluid flow was first described in U.S. Pat. No. 2,052,869 to H. Coanda. The Coanda effect is achieved by the discharge of a small volume of fluid under high velocity from a nozzle having a shaped surface adjacent to it. The stream of fluid (referred to as the "primary fluid") tends to follow the shaped surface and induces surrounding fluid (referred to as the "secondary fluid") to flow with it. The result is a stream of fluid consisting of both the primary and secondary fluids, and a flow-multiplying effect in which of a relatively large amount of secondary fluid is moved by a comparatively small volume of primary fluid.

SUMMARY OF THE INVENTION

This invention takes advantage of the Coanda effect to provide a personal comfort device which efficiently produces a substantial flow of cooling gas near the skin of the wearer.

The personal comfort device in accordance with a first embodiment of the invention, is in the form of a harness of light-weight tubing attached to a source of pressurized fluid. In a second embodiment, a vest-like garment, made from a single layer of light-weight cotton, or other wicking material, is fitted with flow-multiplying tubes attached to a source of pressurized fluid. In either case, the source can be pressurized air or solid carbon dioxide. Solid carbon dioxide sublimes, releasing gaseous carbon dioxide at a pressure up to 40 psi. The tubing can be formed of polyvinyl chloride (PVC), silicone rubber, or a similar non-metallic material, and can be in the form of either a single section or a plurality of sections joined together by connectors. The tubing is preferably formed by extrusion, with a footing that provides a base to insure that the tubing does not rotate. When used in a garment, the footing serves as an anchor that allows the tubing to be attached to a surface of the garment. The tubing has a plurality of perforations, in the form of pin-holes or slits, for releasing air, carbon dioxide or other gas. The footing, which preferably has a flat face, serves to maintain proper positioning of the openings of the tubing inside the garment, and is fastened to the garment by stitching, adhesive or other suitable fastening means.

In one embodiment, the tubing preferably has one or more fins or similar projections extending outwardly from its outer surface. The fins may also be formed in the extrusion process. The fins extend along the length of the tubing adjacent to the perforations.

The perforations are formed in the wall of the tubing at an angle such that gas escaping through the perforations follows the contour of the outer surface of the tube or the contours of the fins so that the escaping gas serves as a primary fluid to induce flow of external air by taking advantage of the Coanda effect. In the case of a fin, when the escaping gas reaches the outermost tip of the fin, turbulent flow is created. This turbulent flow causes ambient air surrounding the tip to be entrained, effecting a flow multiplication. A similar effect is produced when escaping gas is directed along an outer surface of the tubing. Thus, the overall effect is to provide a harness or vest-like garment with a large number of small "fans" inside it, which create a cool breeze against the skin of the wearer.

It is therefore an object of the invention to provide a personal comfort apparatus in the form of a harness or a lightweight, vest-like garment that directs cool gas onto or near the skin of the wearer efficiently.

It is another object of the invention to provide a personal comfort apparatus that utilizes the Coanda effect to produce a substantial flow of gas and ambient air efficiently and inexpensively.

It is still another object of the invention to provide a personal comfort apparatus that is connectible to a portable supply of pressurized fluid to allow the wearer complete flexibility of movement.

These and other objects, features and advantages of the invention will be more easily and fully understood from the drawings and detailed description,

DETAILED DESCRIPTION

Figure 1:
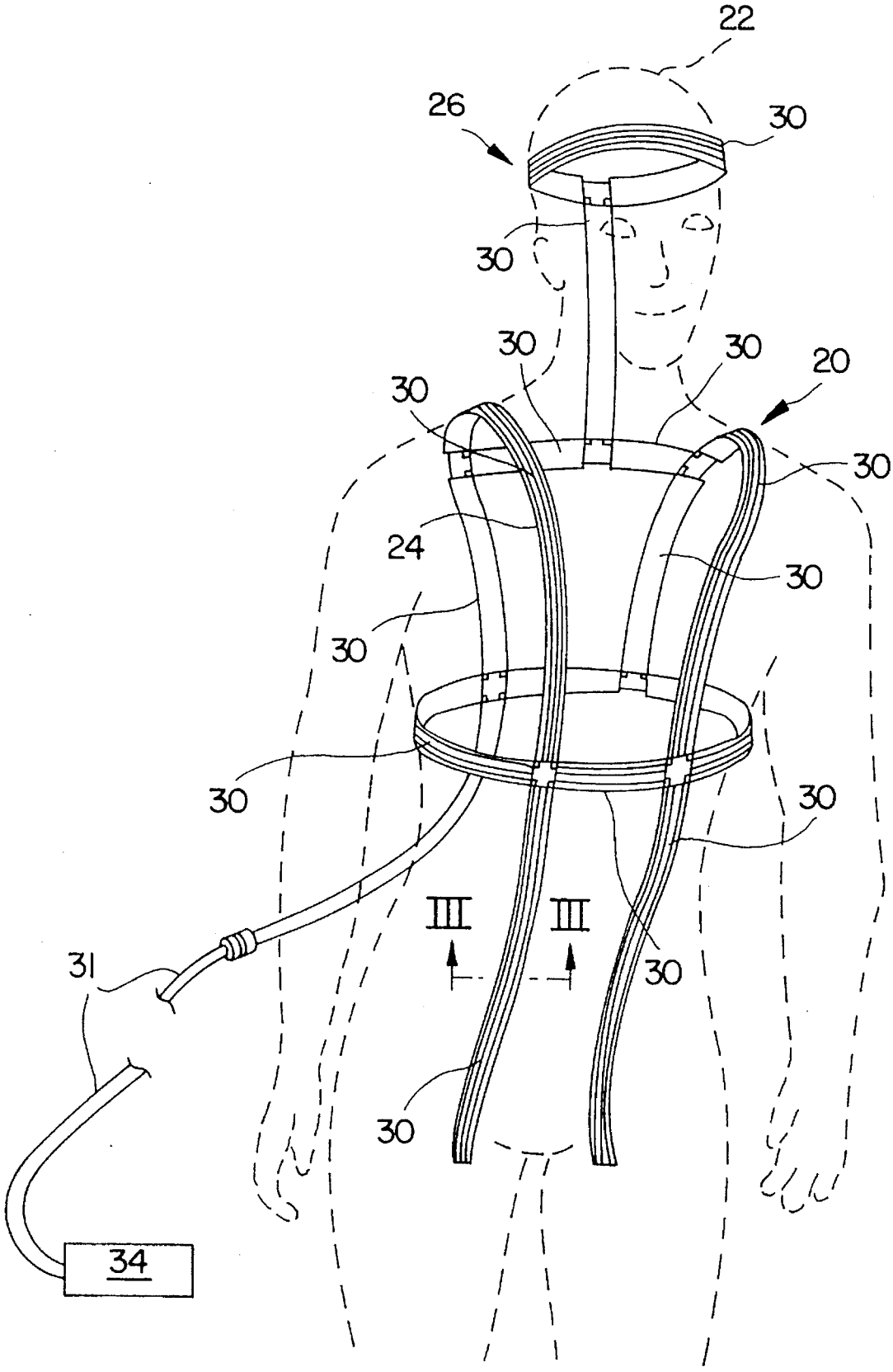
FIG. 1 is an isometric view of a personal comfort apparatus in the form of a harness comprising tubing wrapped over the shoulders, around the chest, down the front of the legs, and around the head of a worker (shown in phantom.
Figure 2:
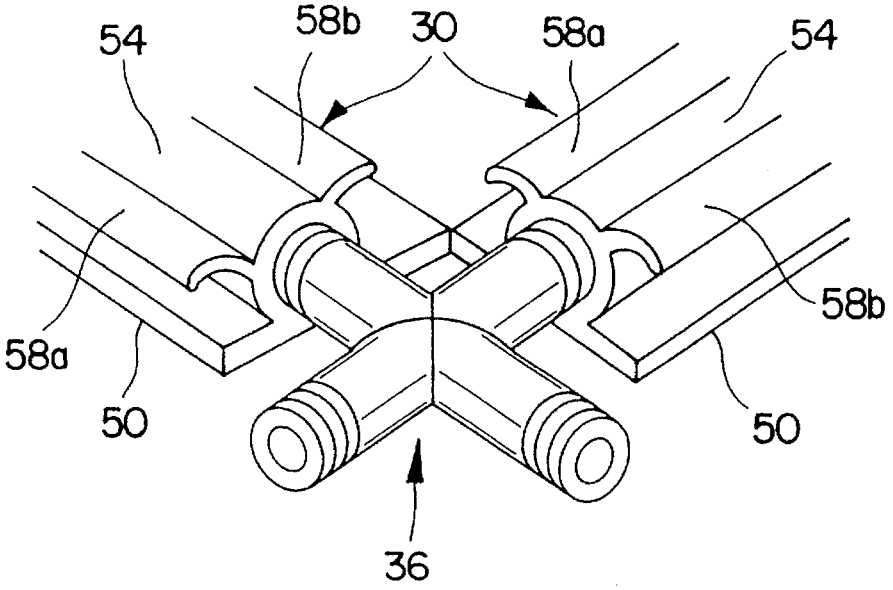
FIG. 2 is an isolated, enlarged isometric view of one form of connector joining the open ends of two sections of tubing.

A preferred embodiment of a personal cooling apparatus is shown in FIG. 1 as a harness 20. A worker 22 can wear cooling harness 20 over a light shirt or coverall (not shown a FIG. 1). Harness 20 comprises a body portion 24 and a head band 26. The harness 20 comprises tubing 30, which can be either a unitary tube or multiple sections of tubing joined together by a connector 36 (as shown in FIG. 2). Harness 20 is connected, via supply line 31, to a source 34 of pressurized fluid, such as compressed or frozen carbon dioxide.

Figure 4:
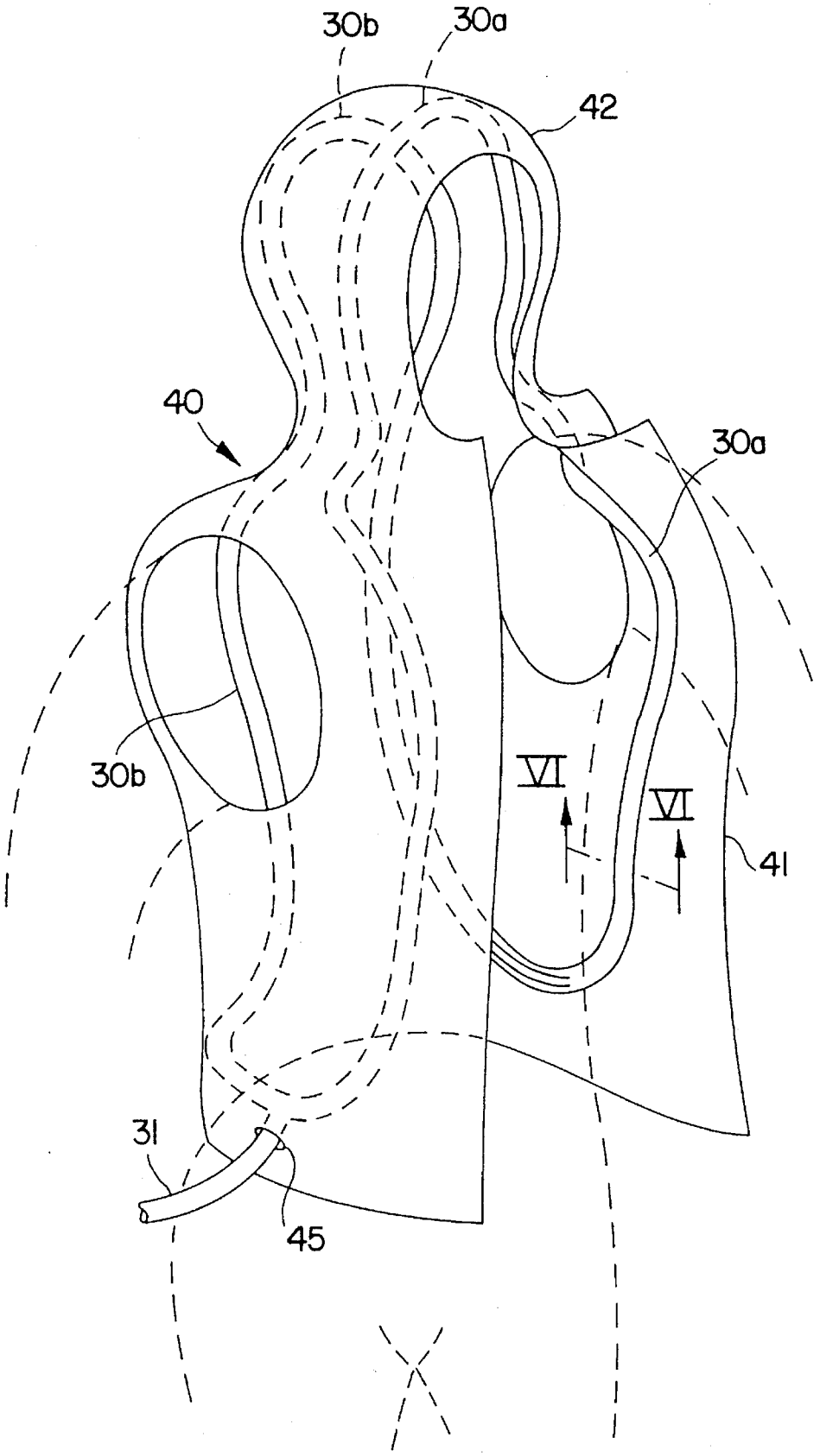
FIG. 4 is an isometric view of a hooded garment with tubing attached on the inside.
Figure 5:
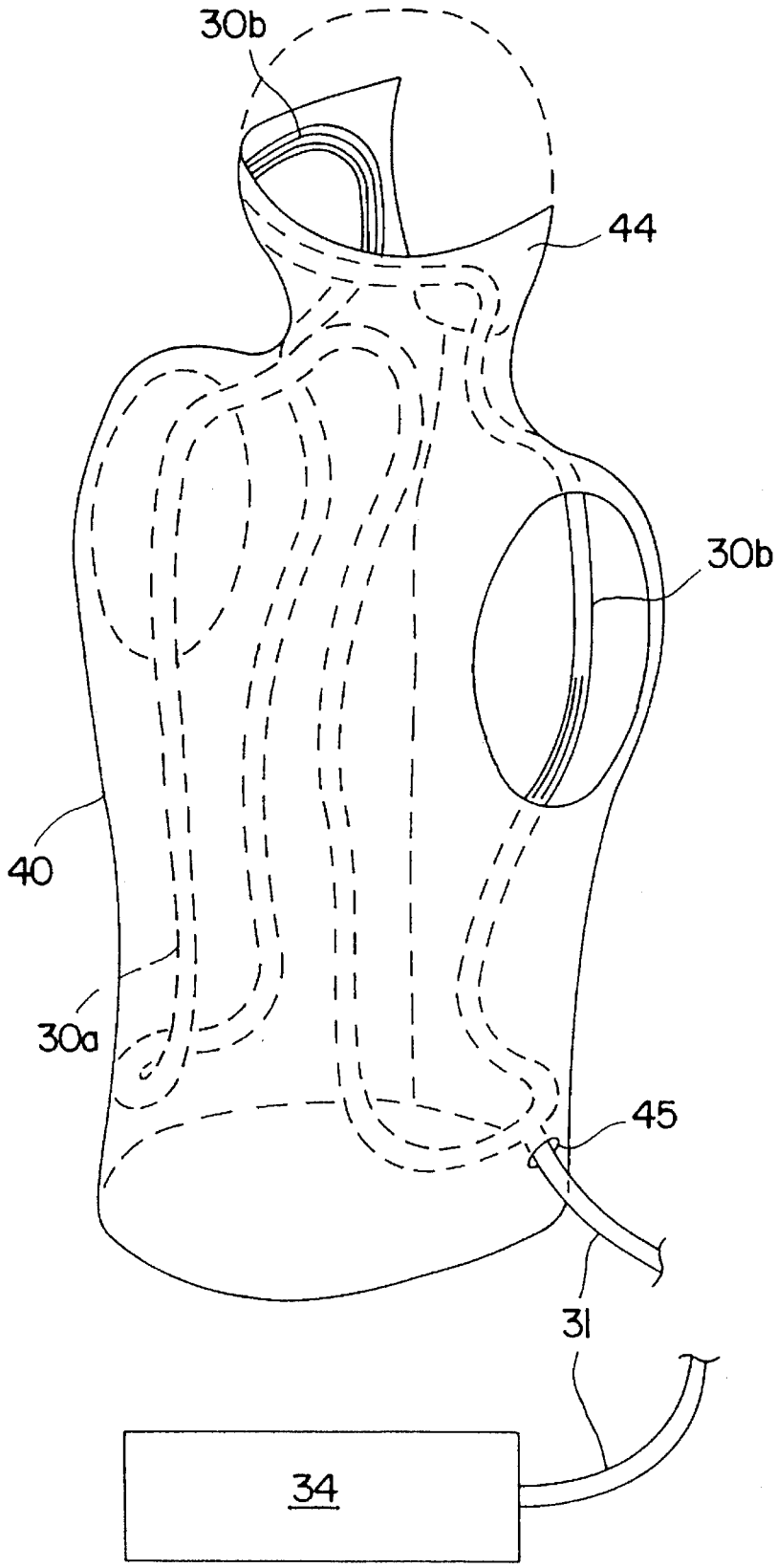
FIG. 5 is an isometric view of the rear side of a modified version of the apparatus of FIG. 4 with the hood removed and with a high collar.

In the alternative, the personal cooling apparatus may be in the form of a garment, as seen in FIGS. 4 and 5. The garment in FIG. 4 is in the form of a vest 40. The main part 41 covers at least the worker's upper torso and a hood 42 covers the head. FIG. 5 shows an alternate embodiment in which the vest 40 is modified to replace the hood with a collar 44. In each of these versions, a supply tube 31 extends into the garment through a small opening 45 and extends around the inside of the garment, in loops 30*a* and 30*b*. The garment can be made from cotton or other, similar wicking materials that absorb moisture.

The escape of gas through the perforations of tubing 30, and the flow of ambient air induced by the Coanda effect provide cooling relief to workers. As shown more clearly in FIG. 3, tubing 30 is formed with a footing 50, which extends tangentially to the tubing wall and preferably has a flat bottom face which sits flat against the body of a worker in the case of a harness, or which is disposed in facing relationship to the interior surface of a garment.

Figure 6:
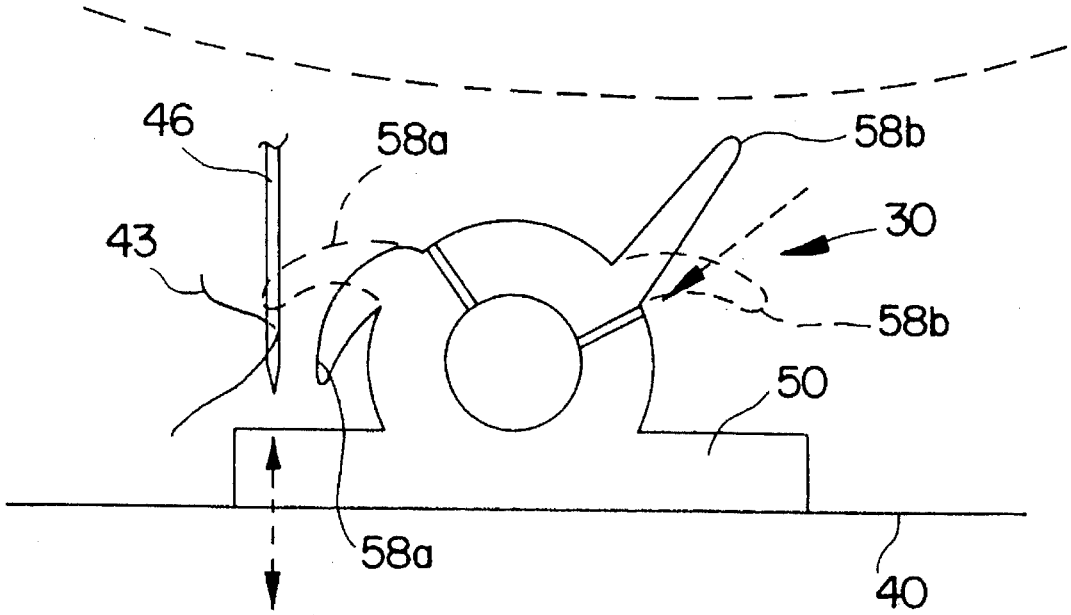
FIG. 6 is a diagrammatic cross-sectional view, similar to FIG. 3, of a tube, showing alternative positions of the perforations, and also showing how the fins can be moved to allow stitching of the footing to a garment surface.
Figure 7:
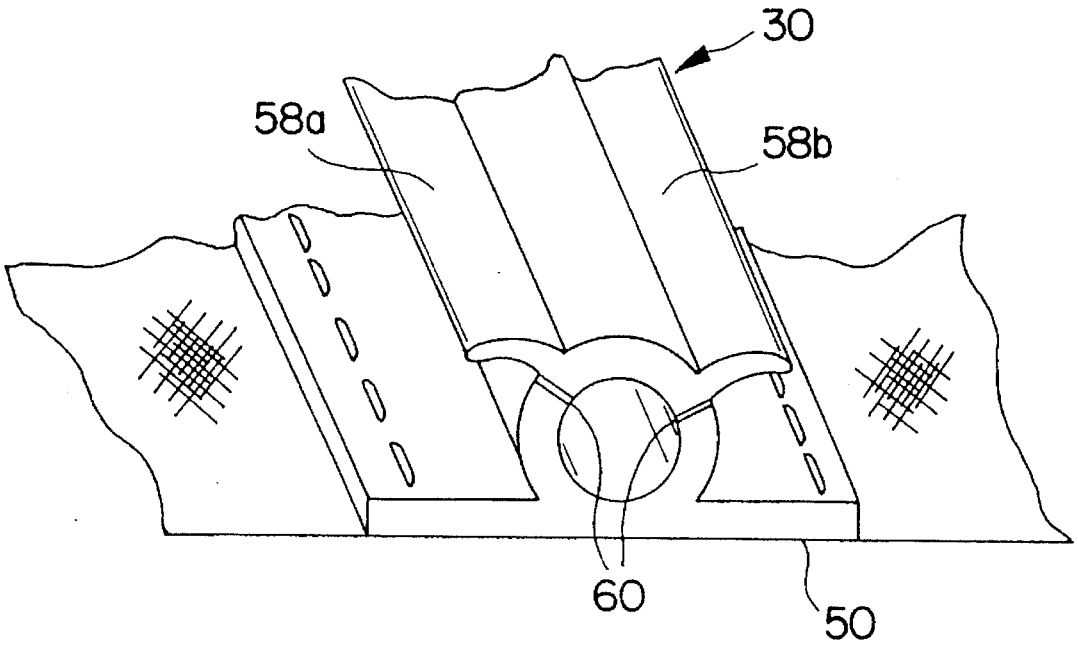
FIG. 7 is a fragmentary isometric view of section of tubing similar to the tubing of FIG. 3, showing the tubing stitched to a garment.

In a preferred embodiment, footing 50 is in the form of a slender bar from 0.450 mm to 0.750 mm wide and 0.065 mm thick. When used in a garment, the tubing 30 is attached by stitching the footing 50 with a needle and thread, to the inside surface of the garment. For example, as shown in FIG. 6, the footing 50 is stitched to the inside surface of a vest 40 by a needle 46 and thread 43, the fin 58*a* being bent aside to provide room for the needle. Footing 50 also holds the tubing 30 in proper relationship to the vest so that the air perforations are positioned for maximum effect.

Figure 8:
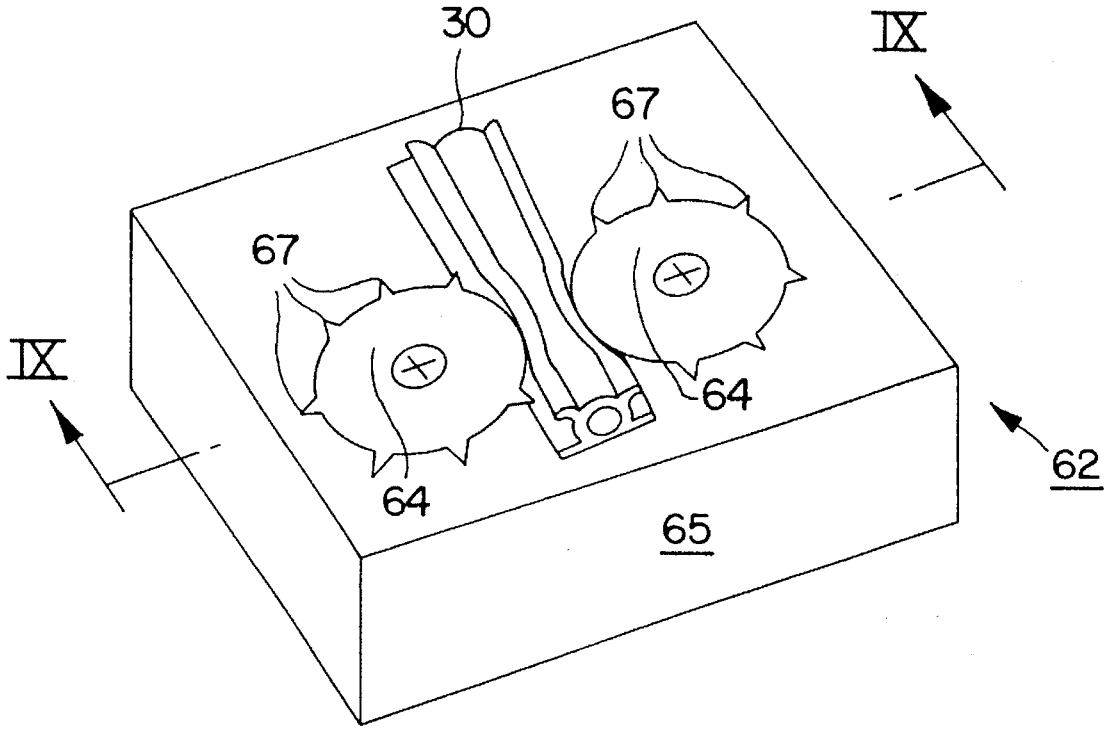
FIG. 8 is an isometric view showing a section of tubing being moved through a pin-hole punching device.

Tubing 30 includes a tube 54 that carries air or other pressurized gas 56. Tubing 54 has walls of about 0.025 mm to 0.075 mm in thickness and is unitary with footing 50 along a section of its outside circumference. Projecting from the side of the tube 54 opposite to the footing 50 is a pair of flexible fins 58*a* and 58*b*. Tubing 30 can be made by extrusion, using a Davis Standard Tubing Extrusion machine available from Furon Corp., Sunnyvale, Calif. Either a plurality of pin-holes 60, or a series of single slits 68, are punched, through the walls of tubing 54, adjacent to fins 58 by a sharp instrument 62, as shown in FIG. 8. The perforations can be either above or below the fins, as shown in FIG. 6, where one perforation is shown above fin 58*a* and another perforation is shown below fin 58*b*. Thus, in FIG. 6, proceeding circumferentially around said tubing in the clockwise direction, the footing is followed, in order, by a first fin of the pair, and a first group of perforations.

Figure 9:
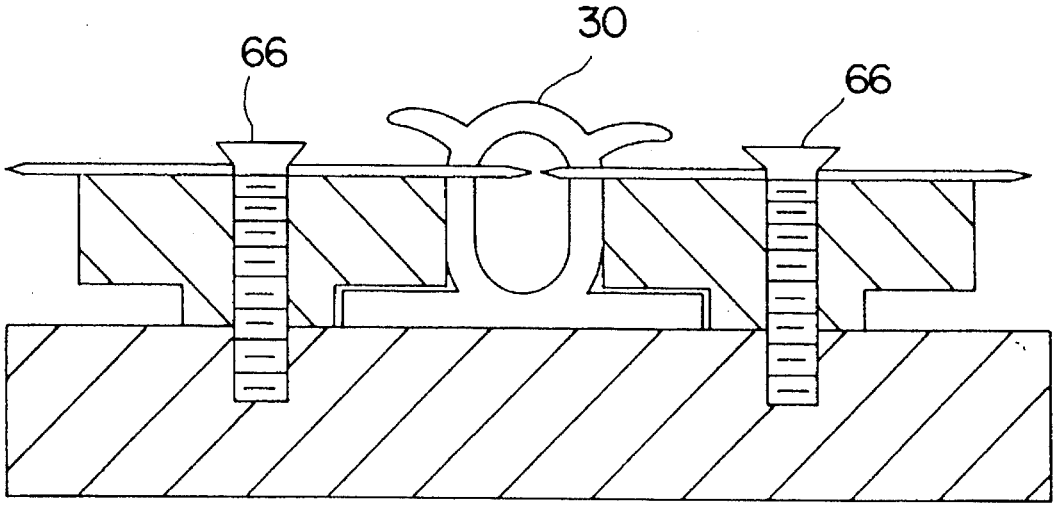
FIG. 9 a cross-sectional view, taken on plane IX—IX of FIG. 8, of the pin-hole punching device.

One form of punching instrument that can be employed, as shown in FIGS. 8 and 9, comprises a pair of wheels 64 rotatably mounted on a block 65 by pins 66. Each of wheels 64 has sharp spikes 67 on its periphery that puncture the walls of the tubing 30 as it is pulled between the wheels.

Figure 3:
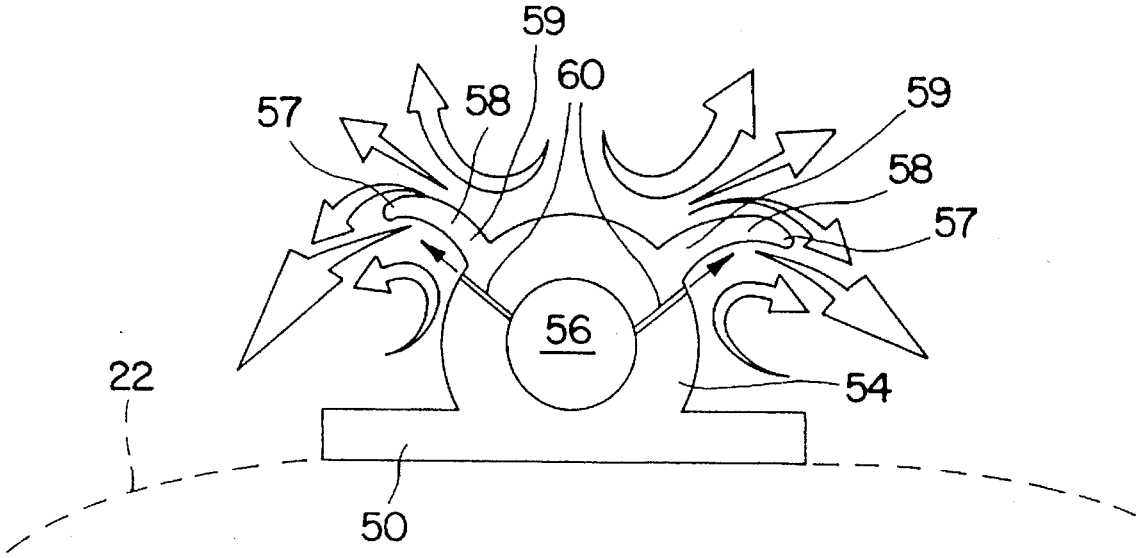
FIG. 3 is a diagrammatic cross-sectional view of the tubing taken on plane III—III of FIG. 1, showing, pictorially, primary fluid flow through a perforation and the entrainment of ambient air.

The perforations 60 are situated adjacent to, but below the fins, as shown in FIG. 3. Therefore, proceeding circumferentially around the tube in either direction, the footing 50 is followed, in order, by a first group of perforations, a first fin of the pair, a second fin of the pair, and a second group of perforations.

Compressed gas from source 34 (FIG. 1), is introduced to tubing 30. Each perforation 60, as shown in FIG. 3, acts as a regulator, expanding if gas pressure increases and contracting as gas pressure decreases, thereby causing the velocity of air flow to remain constant. Also, the perforations 60 provide uniform restrictions along the length of the tube since the substance that the tubing 30 is made from is elastic, and expands and contracts in accordance with the air pressure within the tube.

Figure 10:
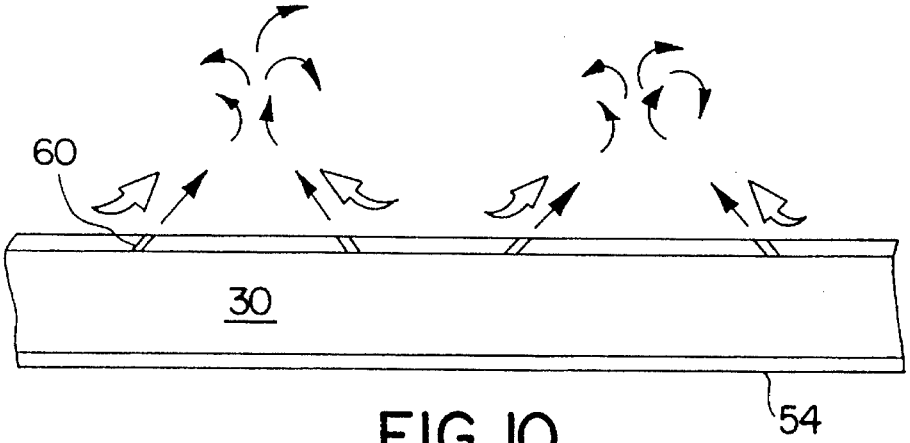
FIG. 10 is a plan view of a section of tubing showing pictorially the interference of gas streams emitted by perforations formed at angles such that adjacent gas streams converge.

As seen in FIG. 10, each perforation 60, may be punched through the wall of the tubing 54 at an angle such that the gas streams escaping from adjacent perforations converge, thereby producing an increased flow.

FIG. 3 shows that escaping gas, starting at the bases 59 of the fins, follows the contours of the fins, flowing along their undersides in sheets toward the tips 57, where it produces turbulent flow and, by virtue of the Coanda effect, induces a flow of ambient air to produce a flow multiplication. Preferably, but not necessarily, the gas admitted to the interior of the tubing can be dried air, or another gas less humid than the surrounding atmosphere. It has been found that the effect of the personal cooling apparatus is to create a plurality of moving air sources, in close proximity to one another, which combine to cause a cool breeze to flow over the skin of a worker.

Fins 58 are preferably from 4 mm to 8 mm in length from base to tip, and are preferably flexible so that they can be "flexed" out of the way when perforations are punched or cut in the tubing wall.

FIGS. 11 through 15 show alternative embodiments of the tubing 30.

Figure 11:
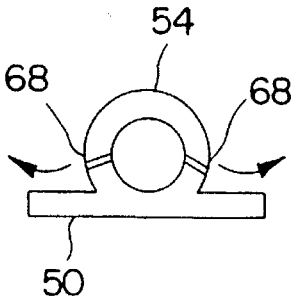
FIG. 11 is a cross-sectional view, similar to FIG. 3, of an second alternative embodiment of the tubing.
Figure 12:
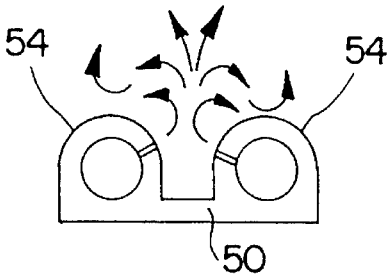
FIG. 12 is a cross-sectional view, similar to FIG. 3, of a third alternative embodiment of the tubing.
Figure 13:
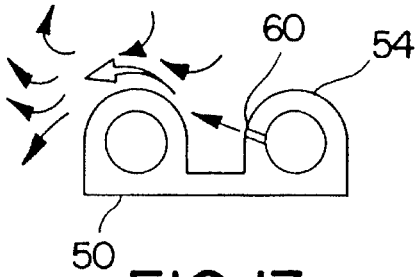
FIG. 13 a cross-sectional view, similar to FIG. 3, of a fourth alternative embodiment of the tubing.
Figure 14:
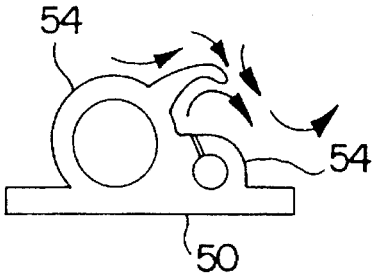
FIG. 14 is a cross-sectional view, similar to FIG. 3, of a fifth alternative embodiment of the tubing.
Figure 15:
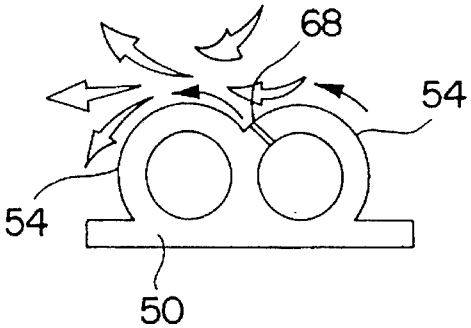
FIG. 15 is a cross-sectional view, similar to FIG. 3, of a sixth alternative embodiment of the tubing.

In FIG. 11, no fins are employed on the outer surface of tube 54. Rather, the perforations 68 are directed toward the footing, which provides the surfaces over which the escaping gas flows in sheets to produce the Coanda effect.

FIGS. 12 through 15 show similar variations of tubing having dual fluid-conducting passages 54. In each case the contour of one of the tubes provides a surface over which the escaping gas flows in sheets.

Figure 16:
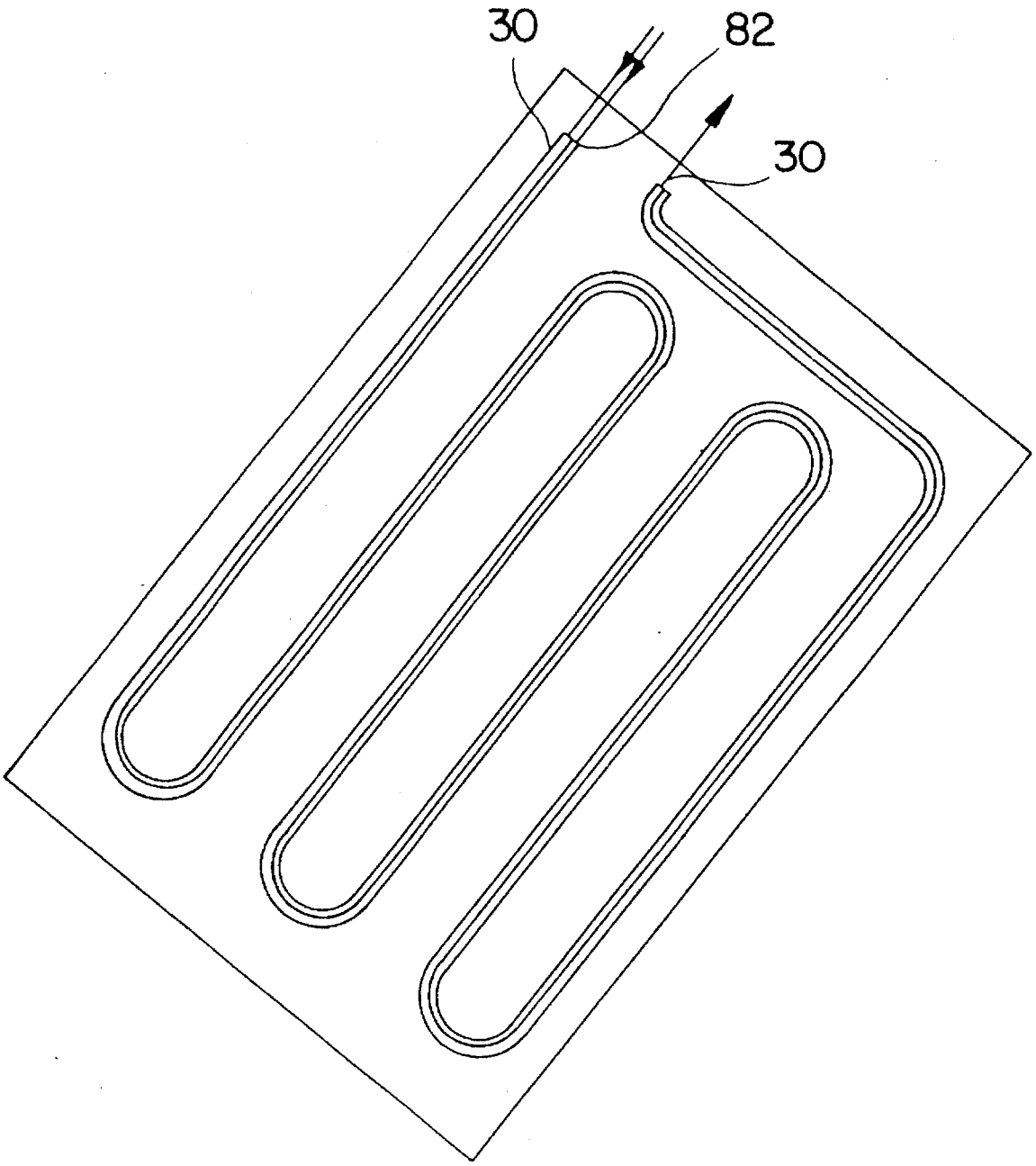
FIG. 16 is an isometric view of the tubing incorporated into a personal comfort device in the form of a blanket.

As shown in FIG. 16, tubing may be employed in a blanket or similar covering, which may be used in a hospital or nursing home environment to warm or cool a patient. In this embodiment, a gas is pumped into tube 30. The gas may be either cooler or warmer than the ambient environment. Additionally, a fluid, cooler or warmer than the ambient environment, is circulated through a second tube 82. As a result, either cool air or warm air may be entrained along with the air flowing out of the perforations in tubing 30, to cool or warm a patient.

Finally, while the personal cooling device has been described with reference to a particular embodiment, it should be understood that the embodiment is merely illustrative as there are numerous variations and modifications which may be made by those skilled in the art. As an example, the tubing can be attached to the outside of an undergarment, instead of to the inside of an outer garment. In another application, the tubing can be used inside of the housings of electronic devices to effect cooling of components. In still another applications the tubing can be employed along with cooling apparatus inside freezer trucks carrying cargo that must remain at a specified temperature. Thus, it should be understood that the invention is not restricted to the details of the illustrated and described embodiments but is susceptible to modifications and adaptations and is to be construed as limited only by the spirit and scope of the appended claims.

What I claim is:

1. A personal comfort apparatus comprising means for supplying a gas, and at least one section of tubing connected to said gas supplying means and having means comprising a plurality of perforations therein for the escape of gas from the interior of the tubing to the exterior thereof, and means formed as a unit with said tubing and providing a surface adjacent to the perforations, wherein the means for the escape of gas directs escaping gas toward the surface to produce a flow of gas over, and in contact with, the surface, whereby flow of ambient air is induced by the flow of gas over the surface.

2. A personal comfort apparatus as defined in claim 1 wherein said surface-providing means is a fin on the exterior of the tubing and extending outwardly from the tubing, and the surface adjacent to the perforations is a surface of the fin.

3. A personal comfort apparatus as defined in claim 1 including a garment comprising a layer of material, wherein said tubing has a footing projecting therefrom and lying against and fastened to said layer of material, said surface adjacent to the perforations is a surface of a portion of said footing.

4. A personal comfort apparatus as defined in claim 1 wherein the surface-providing means is a flexible projection on, and extending outwardly from the exterior of, the tubing, and the surface adjacent to the perforations is a surface of the flexible projection.

5. A personal comfort apparatus as defined in claim 1 in which said section of tubing is an elongated tube having an outer wall and a footing extending along the length thereof, said footing being in the form of a strip unitary with, and tangential to, said outer wall, and in which said means providing a surface comprises a pair of fins unitary with said tube and extending outwardly therefrom along the length of said tube, and wherein said perforations include a first group of perforations located adjacent to one of said fins, and a second group of perforations located adjacent to the other of said fins.

6. A personal comfort apparatus according to claim 5 in which, proceeding circumferentially around said tube in at least one direction, the footing is followed, in order, by a first fin of said pair, and said first group of perforations.

7. A personal comfort apparatus according to claim 5 in which, proceeding circumferentially around said tube in either direction, the footing is followed, in order, by said first group of perforations, a first fin of said pair, a second fin of said pair, and said second group of perforations.

8. A personal comfort apparatus as defined in claim 1 wherein said perforations are sufficiently flexible to allow a substantial increase in fluid flow therethrough as the pressure of the gas supplied by said gas supplying means increases.

9. A personal comfort apparatus according to claim 1 in which said perforations are disposed in a line adjacent to said surface and sufficiently close to one another that gas escaping through said perforations flows over said surface as a sheet.

10. A personal comfort apparatus comprising means for supplying a gas, and at least one section of tubing connected to said gas supplying means and having a plurality of perforations therein for the escape of gas from the interior of the tubing to the exterior thereof, each of said perforations being disposed to direct a stream of gas flowing therethrough toward at least one of an adjacent surface unitary with the tubing and a stream of gas emitted through another of said perforations, whereby an improved flow of ambient air is induced by the flow of gas through the perforations.

11. A personal comfort apparatus comprising means for supplying a gas, and at least one section of tubing connected to said gas supplying means and having a plurality of perforations therein for the escape of gas from the interior of the tubing to the exterior thereof, each of said perforations being disposed to direct a stream of gas flowing therethrough toward a stream of gas emitted through another of said perforations, whereby an improved flow of ambient air is induced by the flow of gas through the perforations.

* * * * *